US005284235A

United States Patent [19]

Tanaka

[11] Patent Number: 5,284,235

[45] Date of Patent: Feb. 8, 1994

[54] COIN DOOR ASSEMBLY

[75] Inventor: Yoshinobu Tanaka, Saitama, Japan

[73] Assignee: Asahi Seiko Kabushiki Kaisha, Tokyo, Japan

[21] Appl. No.: 986,924

[22] Filed: Dec. 8, 1992

[30] Foreign Application Priority Data

Dec. 9, 1991 [JP] Japan ..... 3-113942[U]

[51] Int. Cl.[5] ..... G07D 1/04

[52] U.S. Cl. ..... 194/344; 194/350

[58] Field of Search ..... 194/350, 242, 244, 344

[56] References Cited

U.S. PATENT DOCUMENTS 4,509,631 4/1985 Kim ..... 194/350

4,545,474 10/1985 Ridgley et al. ..... 194/350

5,165,511 11/1992 Lorenzo Rigidor ..... 194/350 X

*Primary Examiner*—F. J. Bartuska

*Attorney, Agent, or Firm*—Hopgood, Caliamfde, Kalil, Blaustein & Judlowe

[57] ABSTRACT

A coin door assembly is provided comprising a service door panel having a front surface, an inner surface and a coin selector assembly associated with the inner surface. The coin selector assembly is comprised of a pair of spaced chutes attached to the inner surface of the door panel which includes a coin selector secured to the inner surface of the door panel disposed between the chutes, the coin selector having a front surface and a rear surface, with the front surface facing the inner surface of the door panel. The coin door assembly is provided with means for holding the coin selector in place. A lock lever is provided pivoted to the inner surface of the door panel for correctly positioning the coin selector, the lock lever having a clamp piece cooperatively associated therewith.

2 Claims, 4 Drawing Sheets

PRIOR ART

COIN DOOR ASSEMBLY

BACKGROUND OF THE INVENTION

This invention relates to a coin door assembly applied to a pinball machine (pin table) or an upright-type coin operated gaming machine.

Conventionally, such a coin door assembly is fixed in an opening of a front surface of the pinball machine of the upright-type coin operated gaming machine. As shown in FIG. 1, a conventional coin door assembly comprises a coin slot 2 and a coin return opening 3 formed on a service door panel 1. The service door panel 1 has a cancel button (not shown), a coin thrown or discharge chute 4, a coin acceptance chute 5 and a micro-switch for acceptance signals (not shown). A service door frame 6 is fixed to the periphery of the opening of the front surface. The service door flame 6 holds the service door panel 1 hinged thereto. In addition, a drop-type coin selector 7 is disposed between the coin thrown chute 1 and the coin acceptance chute 5.

In the coin door assembly as described above, the coin selector 7 is removably attached to the service door panel 1 in order to make it possible to replace and repair the coin selector 7. As shown in the figure, selector holding pieces 8 are typically disposed on the coin thrown chute 4 and the coin acceptance chute 5 for holding the coin selector 7. These holding pieces 8 are forced to an inner flange 9 of the coin selector 7. The selector holding pieces 8 are secured to the coin selector 7 through fixing screws 10. By means of tightening the fixing screws 10, the coin selector 7 is forced to the panel surface of the service door panel 1. Thus, the coin selector 7 is fixedly interposed between the coin thrown chute 4 and the coin acceptance chute 5.

The coin door assembly may have holding ribs and/or holding groove to position the coin selector 7 or to hold it from the outside on the panel surface or the like. Such drop-type coin selector is manufactured in some different manufacturers. The outer dimension of each coin selector is not exactly equal though approximately equal depending on the manufacturer, or even made by the same manufacturer. Thus, it is difficult to correctly dispose the coin selector 7 onto the coin door assembly 1. Such differences in dimension may result in the stress to the coin selector when it is disposed onto the coin door assembly 1. The coin selector 7 may be deformed due to the stress causing an inadequate operation thereof. Even the problem may be due to the fact that the coin selector 7 cannot be disposed. It is much more true in an electronic selector which has frequently been used in recent years. Such electronic selector is relatively large in dimension, i.e., the thickness and the width. Thus, another problem has occurred that it is impossible to correctly fix the coin selector depending only on the outer configuration thereof.

Accordingly, an object of the present invention is to provide a coin door assembly wherein the coin selector can be disposed without affected by the dimension thereof.

Another object of the present invention is to provide a coin door assembly wherein the coin selector can be readily disposed and removed.

It is another object of the present invention to provide a coin door assembly having a coin selector held thereon substantially free of problem.

It is further object of the present invention to provide a service door panel of a coin door assembly wherein a conventional coin selector can be fixed by using a plurality of fixing pin projected from a surface thereof.

SUMMARY OF THE INVENTION

In order to achieve the above mentioned objects, the present invention provides a coin door assembly comprising a service door panel having an inner surface and a coin selector assembly disposed at said inner surface, said coin selector assembly comprising a pair of chutes attached to said inner surface of said service door panel; a coin selector secured to said inner surface of said service door panel between said chutes, said coin selector having a front surface and a rear surface, and said front surface facing to said inner surface of said service door panel; a first fixing pin projected from said front surface of said coin selector; and a plurality of second fixing pins projected from said rear surface of said coin selector; wherein said coin door assembly further comprises a first holding member secured between rear ends of said chutes for holding said coin selector, said first holding member having a right-angled portion; a second holding member secured to said inner surface of said service door panel; a plurality of L-shaped openings formed on said right-angled portion of said first holding member, said L-shaped openings being equal in number to said plurality of second fixing pins and each of the L-shaped openings receiving the corresponding second fixing pin; a concave formed on said second holding member to receive said first fixing pin, whereby said coin selector is correctly positioned with said first and said second fixing pins being engaged with said concave and said L-shaped openings, respectively; a lock lever pivoted to said inner surface of said service door panel, said lock lever having a first projection projecting from one end thereof; a clamp piece integrally formed with said lock lever to prevent said first fixing pin from moving away from said concave; a second projection projected from said inner surface of said service door panel; and a spring disposed between said first and said second projections to force said clamp piece to said first fixing pin.

In addition, when a plurality of coin selector assemblies are provided, the coin selector assembly may comprise a connection rod for movably connecting the clamp pieces in cooperation with each other.

BRIEF DESCRIPTION OF THE DRAWING

The above mentioned objects as well as the advantages and effects of the present invention will be more apparent from the following description with reference to the drawing in which.

DETAILED DESCRIPTION OF THE PREFERRED EMBODIMENTS

Figure 1:
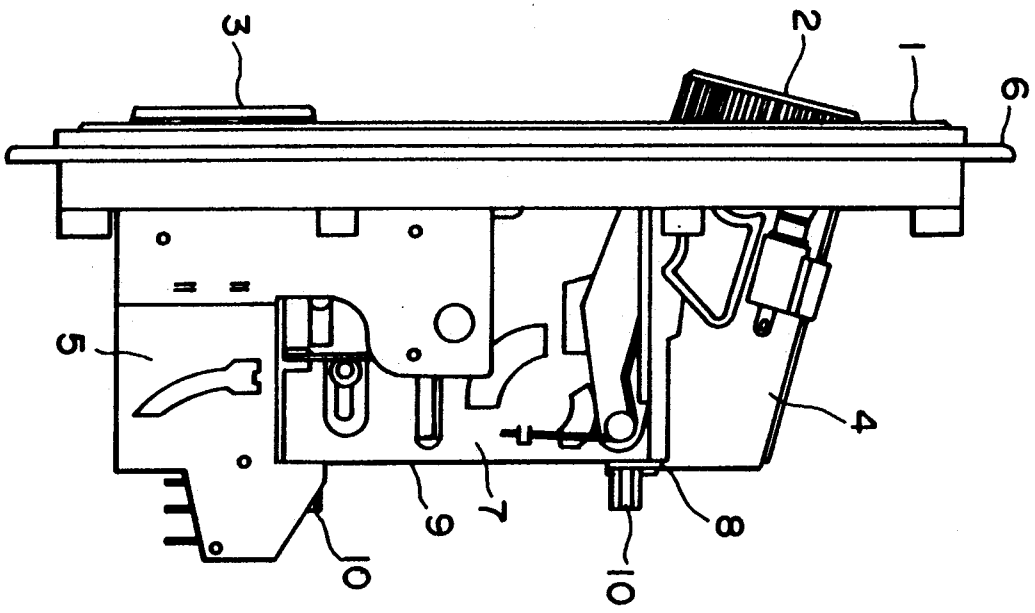
FIG. 1 is a schematical side view of a conventional coin door assembly.

The present invention will be described below with reference to the drawing.

Figure 2:
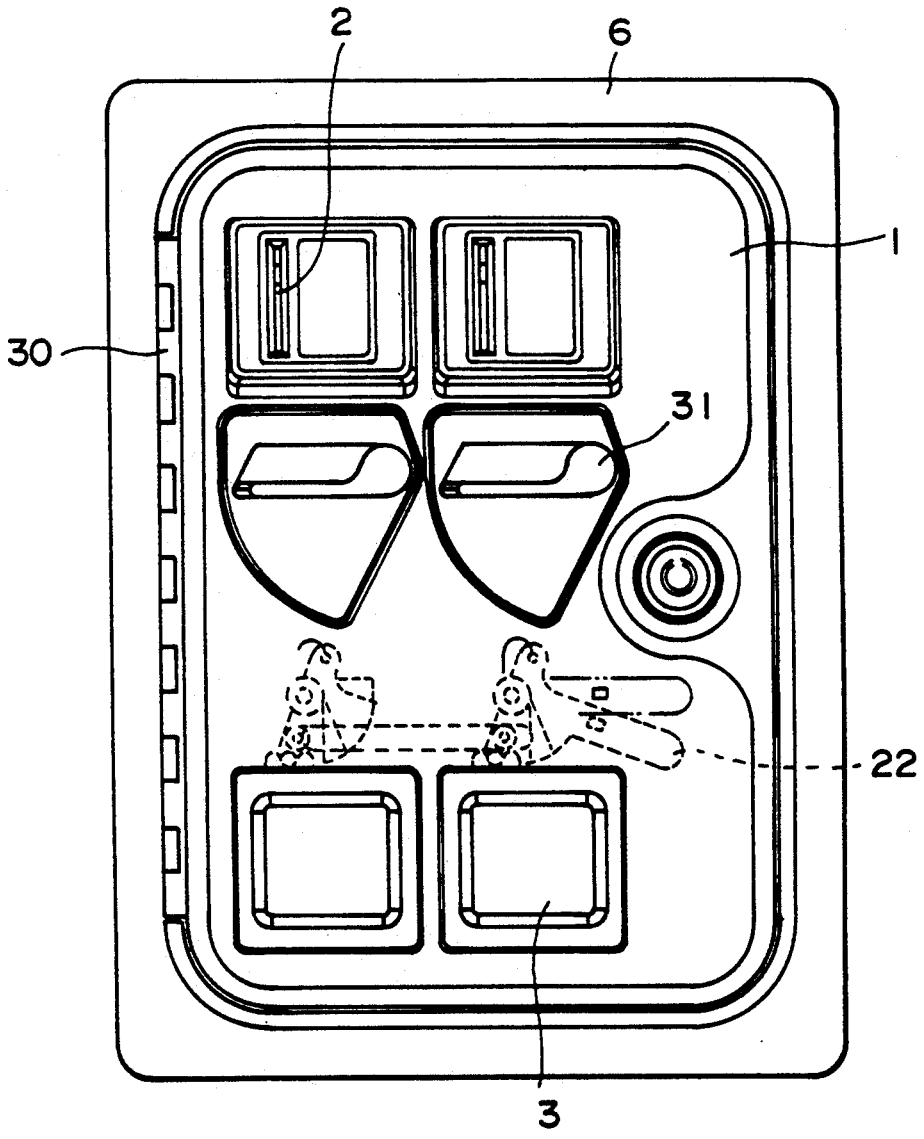
FIG. 2 is a front view of a coin door assembly according to the present invention.
Figure 3:
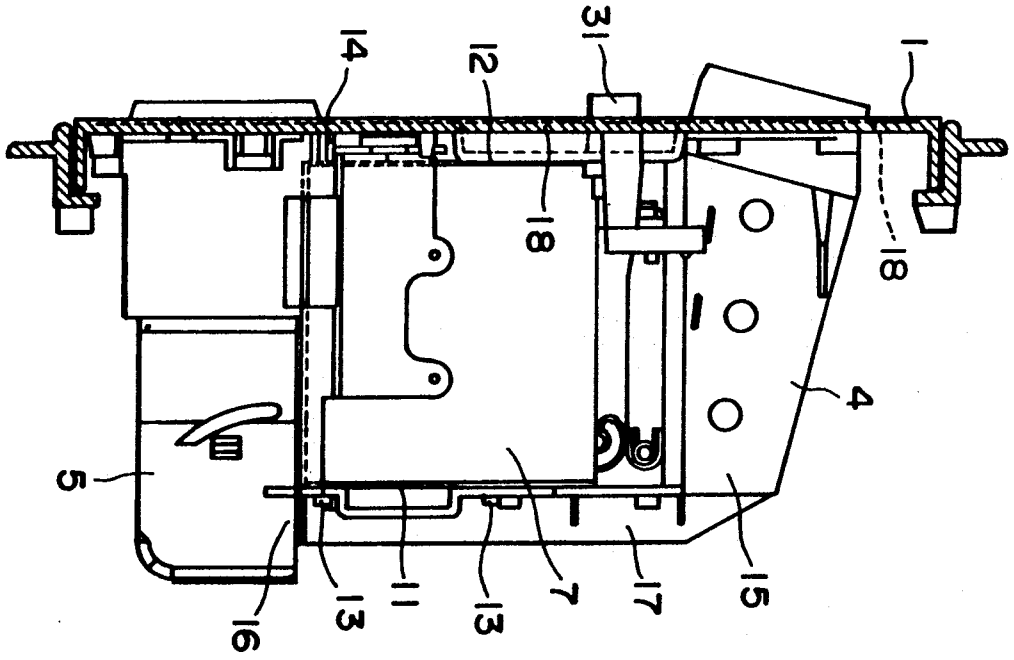
FIG. 3 is a schematical side view of a coin door assembly according to the present invention with a drop-type coin selector attached thereto.
Figure 4:
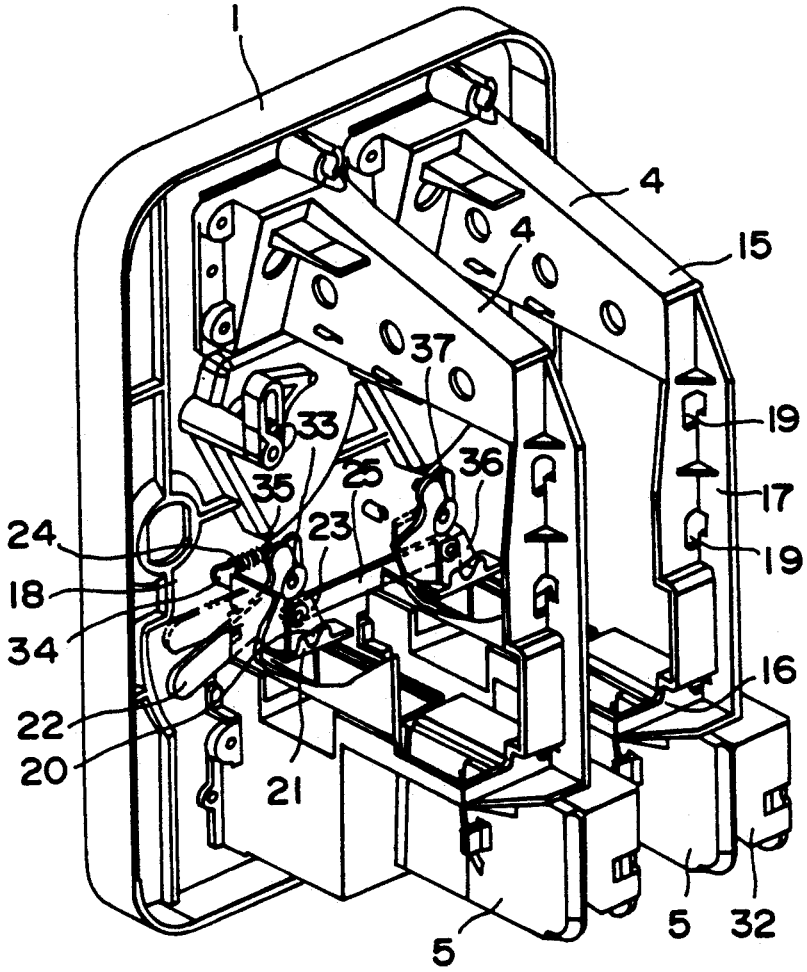
FIG. 4 is a back perspective view of the coin door assembly according to the present invention.
Figure 5:
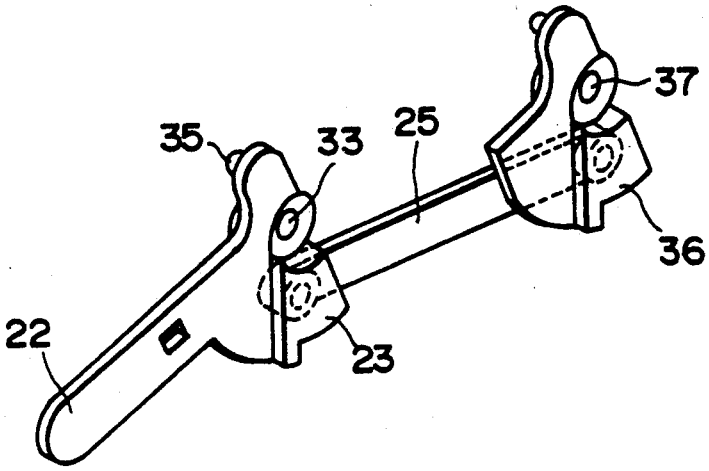
FIG. 5 is a perspective view of a clamp piece.

Referring to FIGS. 2 and 4, the coin door assembly comprises a service door panel 1 hinged to a service door frame 6 by means of hinges 30. The service door flame 6 is secured to a front surface of a coin operated gaming machine or the like. The service door panel 1 comprises a coin slot 2 and a coin return opening 3. The service door panel 1 has a cancel lever 31, a coin thrown or discharge chute 4, a coin acceptance chute 5 and a micro-switch 32 for acceptance signals. A service door frame 6 is fixed to the periphery of the opening of the front surface. The service door frame 6 holds the service door panel 1 hinged thereto. In addition, a drop-type coin selector 7 is disposed between the coin thrown chute 4 and the coin acceptance chute 5. The coin selector 7 has a front flange 12 and a rear flange 11. The front flange 12 faces the inner surface 18 of the service door panel 1. The front flange 12 has a front fixing pin 14 projected therefrom. The rear flange 11 has a plurality of rear fixing pins 13 projecting therefrom.

A holding member 17 is secured between rear ends 15 and 16 of the coin thrown chute 4 and the coin acceptance chute 5, respectively. The holding member 17 is equal in number to the coin selector to be applied to the coin door assembly. In this embodiment, two holding members 17 are disposed as shown in FIG. 4. Each of the holding members 17 has a plurality of L-shaped openings 19 for receiving their corresponding fixing pin 13. More particularly, the L-shaped openings 19 are opened at the right-angled portion of the holding member 17. The coin selector 7 is inserted into the space between the coin thrown chute 4 and the coin acceptance chute 5 from the side thereof. In this event, each fixing pin 13 passes through the L-shaped opening 19. As will later be described more detail, the fixing pin 13 travels along the L-shaped opening 19 to attach the coin selector 7 to the service door panel 1.

A lock lever 22 is pivoted to the inner surface 18 of the service door panel 1 through a pivot pin 33. A fan-shaped clamp piece 23 is integrally formed with the lock lever 22. The lock lever 22 has a pin 35 projecting from the one end thereof. A secure pin 34 projects from the inner surface 18 of the service door panel 1. The secure pin 34 and the pin 35 are coupled through a spring 24.

A selector holder 21 is secured to the inner surface 18 of the service door panel 1. The selector holder 21 has a U-shaped concave 20 to receive the front fixing pin 14. The front fixing pin 14 is slidably received in the U-shaped concave 20. When the coin selector 7 is positioned in the space between the coin thrown chute 4 and the coin acceptance chute 5, the front fixing pin 14 pushes up the clamp piece 23 against the spring force of the spring 24. As mentioned above, the fixing pin 13 travels along the L-shaped opening 19 to attach the coin selector 7 to the service door panel 1. Once the fixing pins 13 are located at the bottom of the L-shaped openings 19, the coin selector 7 can move only in the direction away from and close to the inner surface 18. The coin selector 7 is positioned by means of moving the coin selector 7 in this direction. When the coin selector 7 is correctly positioned, the clamp piece 23 forces the front fixing pin 11 against the bottom of the concave 20 of the selector holder 21. In this manner, the coin selector 7 is correctly disposed in the predetermined position.

In the illustrated embodiment, the service door panel 1 is constructed such that two coin selectors 2 can be attached thereto. Accordingly, the coin door assembly comprises a fan-shaped clamp piece 36. The clamp piece 36 is pivotally supported through a pivot pin 37. The clamp piece 36 is movably coupled to the clamp piece 23 by means of a rod 25. In other words, the clamp pieces 23 and 36 are cooperatively coupled to each other. Thus, it is possible to release two front fixing pins 14 of the coin selectors 7 at once only by means of moving the lock lever 22 against the spring force of the spring 24. In addition, these front fixing pins 14 are held at the lock position by means of one spring 24.

While the present invention has thus been described in conjunction with the coin door assembly with two coin selectors, it is possible to dispose three or more coin selectors. The present invention will be equally achieved by means of preparing the clamp pieces equal in number to the coin selectors 7 and connecting all of the clamp pieces through the rods. Accordingly, it is readily understood by those skilled in the art that various modifications and additions will be made without departing from the scope and spirit described in the attached claims.

What is claimed is:

1. A coin door assembly comprising a service door panel having an inner surface and a coin selector assembly disposed to said inner surface, said coin selector assembly comprising:

a pair of chutes attached to said inner surface of said service door panel;

a coin selector secured to said inner surface of said service door panel between said chutes, said coin selector having a front surface and a rear surface, and said front surface facing to said inner surface of said service door panel;

a first fixing pin projected from said front surface of said coin selector; and a plurality of second fixing pins projected from said rear surface of said coin selector; wherein said coin door assembly further comprises:

a first holding member secured between rear ends of said chutes for holding said coin selector, said first holding member having a right-angled portion;

a second holding member secured to said inner surface of said service door panel;

a plurality of L-shaped openings formed on said right-angled portion of said first holding member, said L-shaped openings being equal in number to said plurality of second fixing pins and each of the L-shaped openings receiving the corresponding second fixing pin;

a concave formed on said second holding member to receive said first fixing pin, thereby said coin selector is correctly positioned with said first and said second fixing pins being engaged with said concave and said L-shaped openings, respectively;

a lock lever pivoted to said inner surface of said service door panel, said lock lever having a first projection projected from one end thereof;

a clamp piece integrally formed with said lock lever to prevent said first fixing pin from moving away from said concave;

a second projection projected from said inner surface of said service door panel; and a spring disposed between said first and said second projections to force said clamp piece to said first fixing pin.

2. A coin door assembly as claimed in claim 1 further comprising at least one connection rod(s) for connecting a plurality of clamp pieces with each other in order to fasten and release a plurality of coin selectors at once.

* * * * *